United States Patent [19]

Hillesheim

[11] 4,068,366

[45] Jan. 17, 1978

[54] METHOD AND APPARATUS FOR PRODUCING OPENINGS IN SHEET MATERIAL

[76] Inventor: Hans Hillesheim, Heinrich Luttig Strasse 2, 6781 Hohfroschen, Germany

[21] Appl. No.: 737,282

[22] Filed: Nov. 1, 1976

[30] Foreign Application Priority Data

Nov. 3, 1975 Germany ..... 2549072

[51] Int. Cl.[2] ..... B21D 31/04

[52] U.S. Cl. ..... 29/527.4; 29/163.5 R; 72/186; 72/187; 113/116 A; 428/596

[58] Field of Search ..... 72/186, 187; 113/116 A, 113/116 Y; 29/6.1, 160, 163.5 R, 180 SS, 527.4; 148/130; 266/51, 70, 261; 428/596

[56] References Cited

U.S. PATENT DOCUMENTS

| | | | |
|---|---|---|---|
| 716,052 | 12/1902 | Kennedy | 29/6.1 |
| 1,166,888 | 1/1916 | Clark | 113/116 A |
| 2,266,552 | 12/1941 | Jones | 266/51 |
| 3,293,725 | 12/1966 | Gunter et al. | 29/6.1 |

*Primary Examiner*—Lowell A. Larson

*Attorney, Agent, or Firm*—Burgess, Ryan and Wayne

[57] ABSTRACT

A method and an apparatus for producing openings in sheet metal material being provided in band form as well as a perforated sheet material produced by said method. The method comprises providing notches in the sheet material and stretching partial areas of the notched sheet material by a thickness-reducing processing step, whereby the notches which lie between the stretched partial areas of the notched sheet material are enlarged to form openings. The apparatus for producing openings in sheet metal material comprises roller means for producing notches in the sheet material and roller means for stretching partial areas of the notched sheet material by thickness reduction. The resulting perforated sheet metal material combines the advantages of punched sheet metal, i.e., mechanical stability, and expanded metal mesh, i.e., no loss of material during production of the openings in the sheet material.

20 Claims, 65 Drawing Figures

METHOD AND APPARATUS FOR PRODUCING OPENINGS IN SHEET MATERIAL

Figure 1:
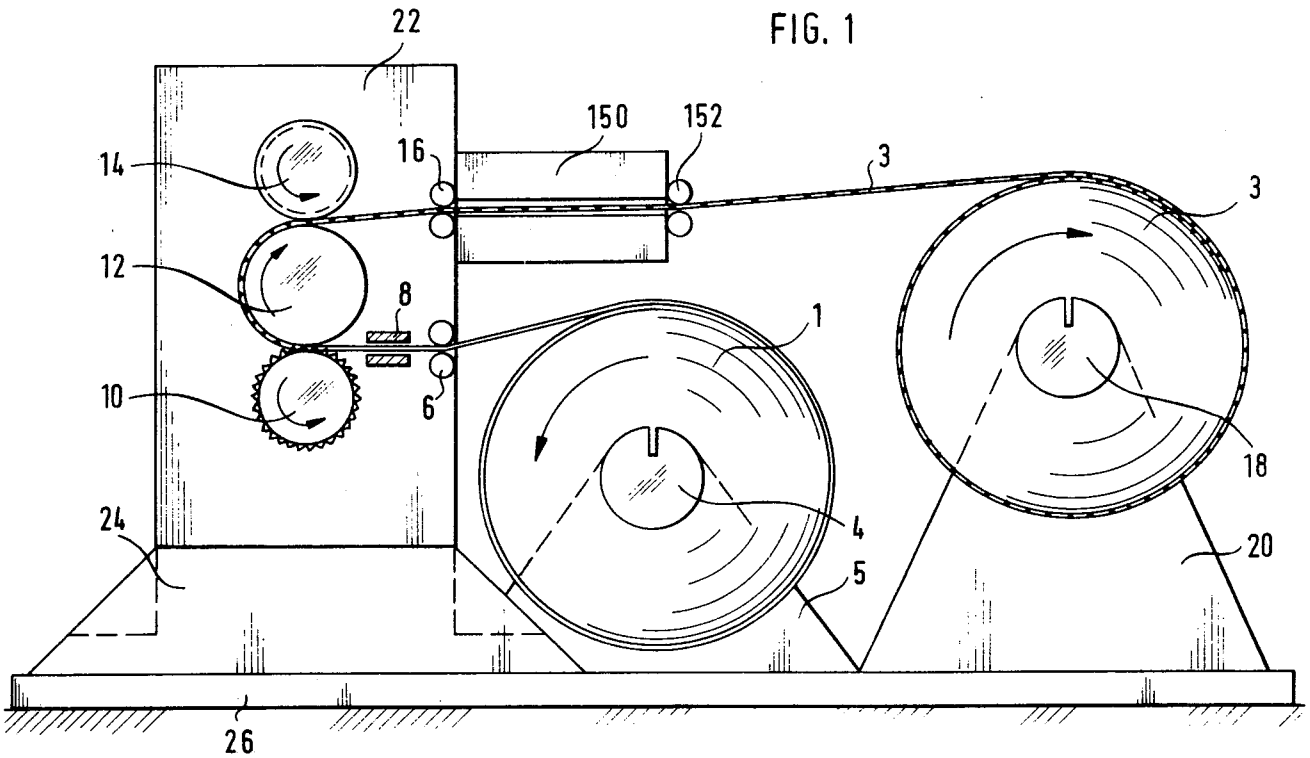

The present invention relates to a method of and an apparatus for the production of openings in sheet material as well as to perforated sheet material thus produced.

Two kinds of method are known of producing through bores or openings in an otherwise solid or unperforated starting material, such as sheet steel. One method provides for punching holes into the initial sheet steel by use of suitable punching tools. This mechanical processing, namely the punching and the relatively great proportion of waste, namely the punched-out parts of the starting material render the punched steel band so expensive that it is used only in cases where such material as expanded metal mesh, wire mesh, and the like cannot be applied for other reasons. The second possibility of obtaining openings passing through the sheet material is to produce expanded metal mesh. With this method cutting tools are used to cut slits into the starting material. Subsequently the slitted material is expanded axially whereby the webs which remained between the slits are deformed about their longitudinal axes by as much as 90°. The expanded metal mesh can withstand only minor mechanical stress because of the bending of the webs and cracks or tensions present in the material. Therefore, such expanded metal mesh can be applied only where the mechanical forces occurring are small. Thus it is utilized as cover over slots in buildings or as safety cover for protection from rotating elements, as air shaft covering, and the like. It is another disadvantage of punched sheet steel as well as expanded metal mesh that the configuration of the edges of the holes passing through the material is limited to a few examples. This is disadvantageous if the punched metal or expanded structure are to be processed together with plastics to establish a composite material or article because it is difficult to coat the edges of the openings in such known materials with plastics.

So far, a problem is encountered when it is desired to produce inexpensive materials of large surface areas which, on the one hand, have good mechanical loading capacity and, on the other hand, are corrosion-proof. Cheap mass-produced sheet metal does have the desired mechanical properties, yet the risk of corrosion is quite great. Cheap plastics do not tend to corrode, but they lack the required mechanical strength and sufficient permanent temperature resistance. In order to combine the advantages of plastics and sheet metal it has already been suggested to coat punched metal sheets or expanded metal mesh with plastics, thus producing the so-called composite materials. Yet even these composite materials have the above mentioned disadvantages of punched metal or expanded metal mesh. Composite materials of punched sheet metal and plastics are so expensive because of the loss of material in producing the punched sheet metal that, in most cases, stainless steel could compete with such composite materials from the point of view of the price. In the production of mass articles, such as drinking water pipe and sectional material of any kind composite materials of punched metal sheet coated with plastics consequently are out of the question because of the cost factor. A composite material of expanded metal mesh and plastics still has the insufficient mechanical load bearing capacity of the expanded metal mesh.

It is, therefore, an object of the present invention to produce openings in an initial sheet material, such as sheet metal, in such a manner that no loss occurs of the starting material. It is another object of the present invention to provide the openings as mentioned in such a manner that the mechanical loading capacity of the starting material remains unaffected in spite of the holes. It is a further object of the invention to facilitate the processing of the sheet material provided with the openings, in particular the coating or covering with non-metallic substances, such as plastics, enamel, lacquer, and the like, by virtue of the shape and arrangement of the openings.

To meet these and other objects which will become apparent as the specification proceeds a method is provided, in accordance with the invention, for producing openings in sheet material, wherein notches are provided in the sheet material and partial areas of the notched sheet material are stretched by a thickness-reducing processing step, enlarging the notches which lie between the stretched partial areas of the notched sheet material to form openings. With this manufacturing method no starting material is lost and the sheet material provided with openings obtained in this manner still has the desired mechanical properties. The ratio between total surface area of the openings and total surface area of the sheet material as well as the planar configuration of the openings and the design of the edges of the openings can be widely varied by the degree of stretching upon reducing the thickness or by the cross sectional shape of the notches, as will be described in detail below.

An advantageous embodiment of the method according to the invention resides in arranging the notches in rows in longitudinal direction of the sheet material and carrying out the thickness-reducing processing step between the stripes provided with the notches. This spacing between the stripe portions provided with the notches and the stripe portions subjected to thickness reduction permits better definition of the parameters of the apertured or perforated sheet material, in particular of the shape and design of the openings and the cross sectional configuration of the final product. Furthermore, simplifications are afforded in the design of the apparatus used to carry into effect the method.

Another advantageous embodiment of the method according to the invention provides for arranging the notches in rows in longitudinal direction of the sheet material and carrying out the thickness-reducing processing step in stripes of the sheet material which are so wide that also the ends of the notches are covered and subjected to the thickness reduction. A processing step which diminishes the thickness of certain partial areas of the sheet material and, at the same time, stretches them, whereas in other areas adjacent the areas so processed the original thickness is retained, creates certain tensions in the transitional areas between the processed portions and the non-processed portions. These tensions in the border zones are compensated to a certain extent if the ends of the notches are included in the thickness reducing step which causes a flow of material in the border zones. It is this balancing of tensions which presents the advantage of this embodiment of the method according to the invention.

The method according to the invention is carried out with an apparatus for producing openings in sheet material, comprising a means for producing notches in the sheet material and a means for stretching partial areas of the notched sheet material by thickness reduction, enlarging the notches which lie between the stretched partial areas of the notched sheet material to form openings. The means for producing the notches as well as the means serving to reduce the thickness of, and to stretch the notched sheet material can be embodied in different forms.

A preferred apparatus for producing openings in sheet material is characterized in that the means for producing the notches comprises a roller and a counter-roller, and in that at least one of the rollers is designed as a notching roller provided with notching teeth distributed over its circumferential surface. Another advantageous embodiment of the apparatus according to the invention resides in the fact that the means for effecting the thickness reduction and stretching of the partial areas likewise comprises a roller and a counter-roller, at least one of these rollers being a sectioned or profile roller, the raised profile faces of which serve to diminish the thickness and stretch the partial areas. On principle, the means for producing the notches and/or the means for thickness reduction and stretching of the sheet material could also be designed to comprise reciprocating ram elements, formed with respective profiles if destined for the notching means and having butt ends if used in the means for thickness reduction and stretching to carry out a kind of forging operation. However, in consideration of the structural design of the apparatus for producing the openings in the sheet material the use of rollers is preferred.

The arrangement of the notching teeth on the notching roller is widely variable. A preferred embodiment of the apparatus is characterized in that the notching teeth are arranged in series or rows in the direction of movement of the notching roller. In this manner the notching roller will produce series or rows of notches in the sheet material in longitudinal direction so that the partial areas which will be subjected to thickness reduction and stretching of the sheet material can be located in predetermined manner either between the notched stripes or such that the ends of the notches project somewhat into the partial areas to be processed. In other words, the position of the notches and the position of the partial areas to be processed can be defined accurately so that, when forming the openings along the length of the sheet material, the geometric relationship and the conditions of compression and tension will always be the same.

A preferred embodiment of the apparatus according to the invention is characterized in that the notching roller comprises a roller core or roller body with roller rings disposed on the same, at least some of which have notching teeth. In another preferred embodiment of the apparatus according to the invention the profile roller comprises a roller body and roller rings disposed on the same to afford te raised profile surfaces. If the notching roller and/or the profile roller each are designed as solid rollers, this requires rather expensive machining of the roller surface to form the notching teeth or the profile faces. On the other hand, the entire roller will have to be taken out of operation in case of damage of the teeth or profile faces. If the rollers are composed of a body and roller rings disposed on the same, the rings not only can be made separately but also can be exchanged, thus offering considerable savings in working hours during production and repair and reducing the down-time of the apparatus.

It is another advantage of the roller composed of rings that the notch pattern is widely variable by appropriate arrangement on the roller body of roller rings provided with teeth and spacer rings. The same applies to the profile roller, its profile may likewise be altered by replacement or different positioning of the roller rings.

In the simplest embodiment the notching teeth may be cut or machined out of the material of the roller rings. This implies that either notching teeth of a lesser degree of hardness have to be accepted or that the entire ring be made of a high grade steel of excellent hardness. In this respect, an advantageous embodiment of the apparatus comprises notching teeth of a material cast into the roller rings. With this kind of roller rings the major part of the ring may be made from a lower grade steel, whereas the notching teeth may consist of high quality steel. Consequently, on the one hand the notching teeth have a long service life and yet the total material expenditure for the roller rings can be reduced.

Another advantageous embodiment of the apparatus is characterized in that the roller rings consist of ring sections connected in form lock. Such a roller ring allows individual sections to be exchanged in case of damage, a fact which offers simpler store keeping of spare parts because instead of full roller rings only ring sections need be kept in store.

Yet another advantageous embodiment of the apparatus according to the invention is characterized in that the notching teeth are fixed individually at the roller ring circumference. If a notching tooth breaks, only this tooth will be replaced, which is another advantageous aspect as for repair time and store keeping of spare parts. Simple and reliable fastening of the notching teeth on the roller rings can be achieved with the apparatus according to the invention by making the roller rings of at least two partial rings connected to each other and defining adjacent their outer circumferences a cut-out in which the notching teeth are anchored by feet of corresponding complementary shape. If a notching tooth is to be replaced in this case, the partial rings are disconnected, the defective tooth is taken out and a new one is inserted. Upon re-assembly the roller ring is again ready for use.

It is evident that different roller arrangements are suitable to provide openings in the sheet material. For instance, it is possible to use a roller stand having two rollers on top of each other, the upper one being the notching roller. In a first pass the sheet material is provided with the notches. Then the notching roller is replaced by the profile roller and, in a second pass, the thickness reduction and stretching processing step is carried out in the respective partial areas. The same result, of course, can also be obtained with two roller stands, each comprising two rollers and one including the notching roller, while the other one has the profile roller, each disposed above a counter-roller, for instance, a smooth surface or plain roller. The sheet material is passed in one pass, first through the roller stand comprising the notching roller and then through the roller stand which includes the profile roller. The two rollerpairs also may be combined in a single roller stand.

An advantageous embodiment of the apparatus according to the invention, with regard to the roller arrangement, is characterized in that a combination roller provided with notching teeth and profile and a counter-roller are provided, and in that the notching teeth of the combination roller serve to produce the notches and the raised profile faces of the combination roller serve for simultaneously reducing the thickness and stretching the partial areas which are to be processed. This embodiment of the roller requires only two rollers for the manufacture of the perforated sheet material. Advantageously, also this apparatus can be so designed that the combination roller comprises a roller body or core on which there are profile roller rings and rings provided with notching teeth.

Another advantageous embodiment of the apparatus according to the invention is characterized in that the means by which the notches are made in the sheet material comprises a notching roller with notching teeth, that the means by which the partial areas of the notched sheet material are stretched by thickness reduction comprises a profile roller, the raised profile faces of which correspond to the partial areas, and that the notching roller and the profile roller are disposed at one and the same counter-roller. This arrangement requires only three rollers, and the position of the notching teeth on the notching roller as well as the provision of the profile faces on the profile roller can be chosen practically independently.

The perforated sheet material produced according to the invention has good inherent stability and is capable of withstanding great mechanical stress, such as compression, tension, and upsetting forces. In specific cases of application where the perforated sheet material is subjected to permanent oscillations, cracks or fissures may be observed at the ends of the notches or openings. Although this does not occur until much higher oscillation loads are reached than with expanded metal mesh, it is desirable to improve the perforated sheet material according to the invention in this respect. To this end the apparatus according to the invention for making the openings in the sheet material, in addition, is advantageously characterized by a heating means to effect fusion deformation of the edges of the openings in the perforated sheet material. In its simplest form the heating means consists of an arrangement of gas flames directed against the sheet material.

The edges of the openings melt under the influence of the gas flames and, upon solidification of the material, beadlike reinforcements are obtained at the ends and edges of the openings. The resulting heat-treated perforated sheet material has the desired stability even under oscillation stress. Other embodiments of the heating means are conceivable. For example, the heating means may be an induction heating means.

The invention also is directed to the perforated sheet material obtained by the invention. The sheet material in accordance with the invention is useful for a great number of purposes. In practice it has already proved its usefulness in the production of plastics-coated pipes, as carrier and form material in reinforced concrete structures, and as inner pipes of exhaust gas pipes for motor vehicles.

Figures 2A, 2B, 3A, 3B, 4A, 4B:
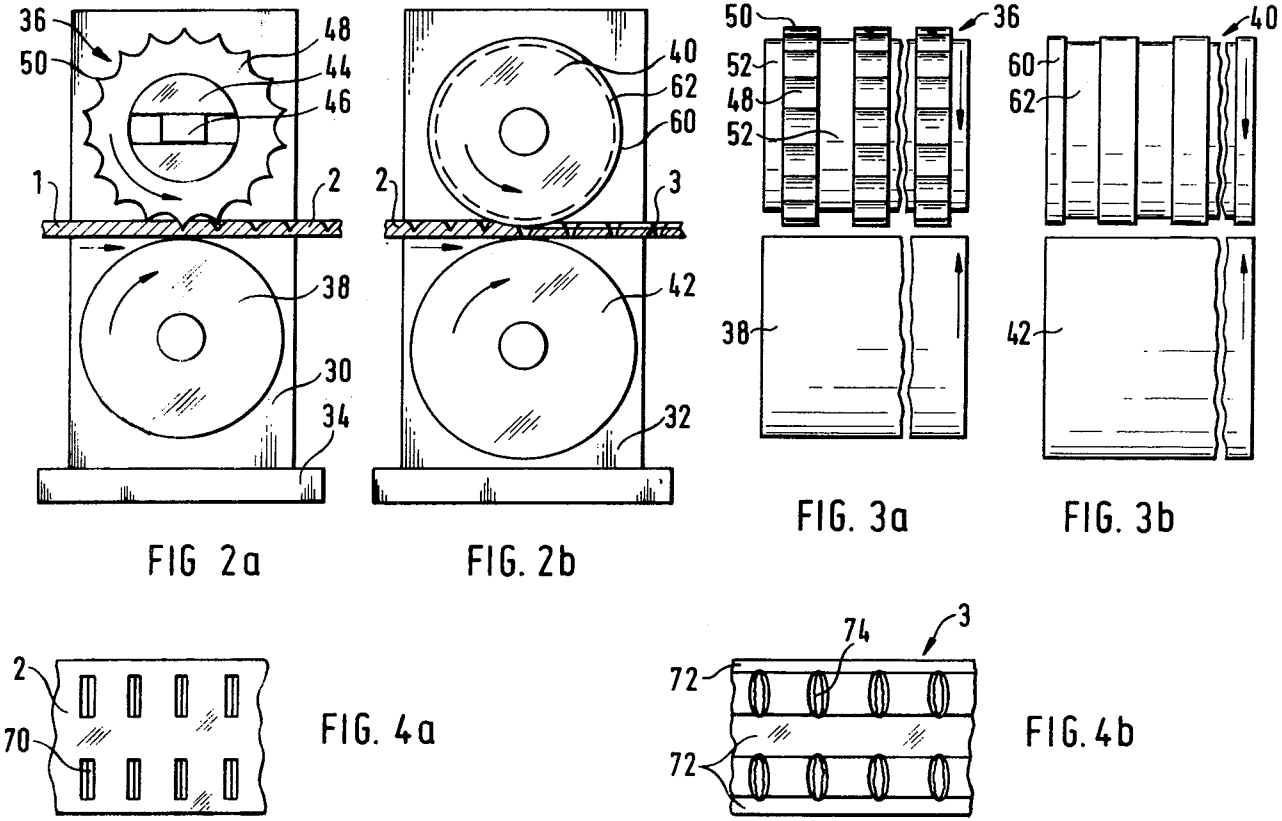
Figure 5A:
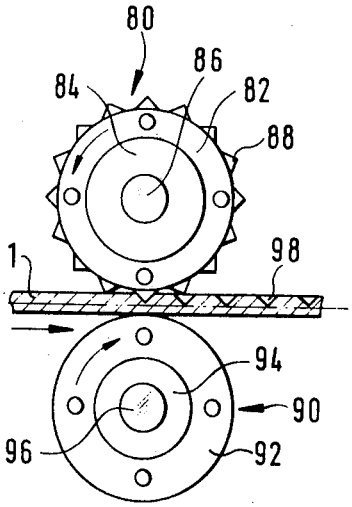
Figure 5B:
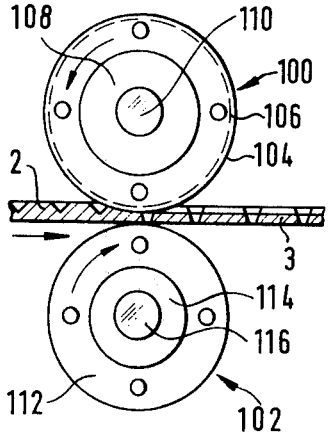
Figure 5C:
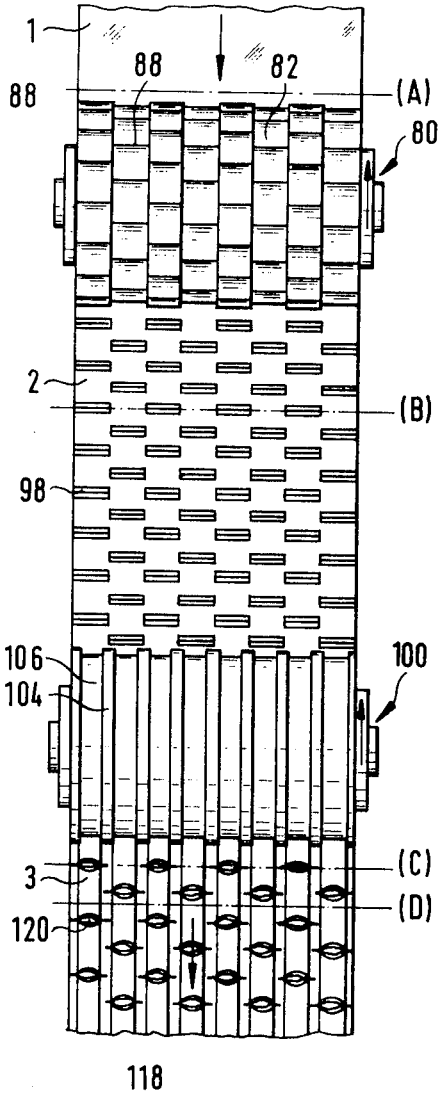
Figure 6A:
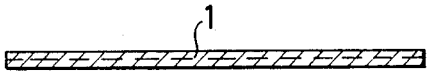
Figure 6B:
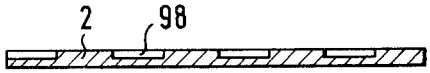
Figure 6C:
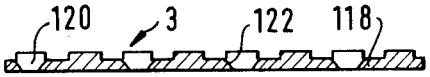
Figure 6D:
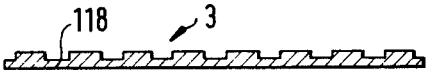
Figure 7A:
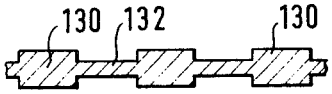
Figure 7B:
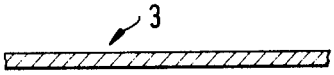
Figure 7C:
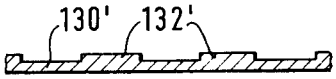
Figure 8:
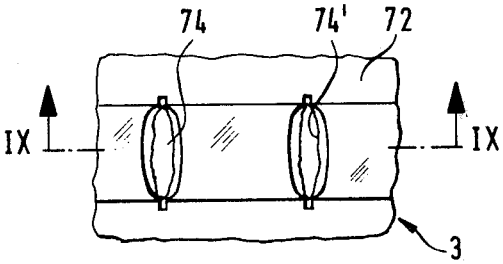
Figure 9:
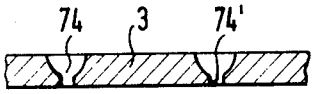
Figure 10:
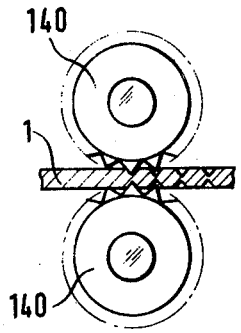
Figure 12:
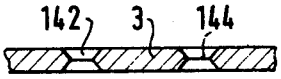
Figure 11:
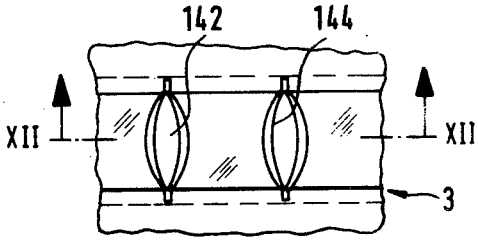
Figure 13:
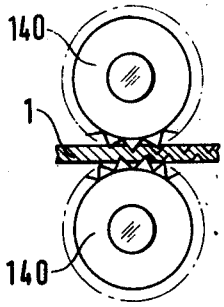
Figure 14:
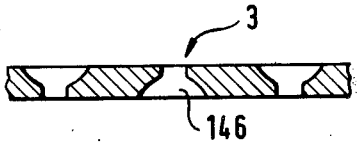
Figure 15:
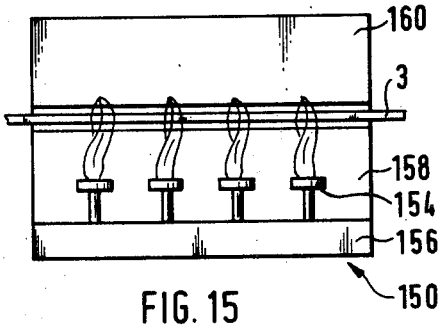
Figure 16:
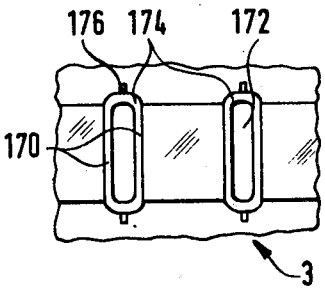
Figure 17:
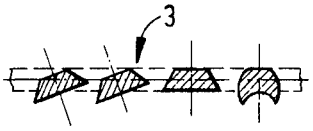
Figure 18:
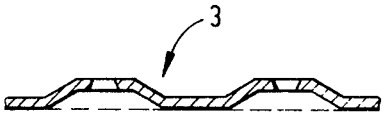
Figure 19A:
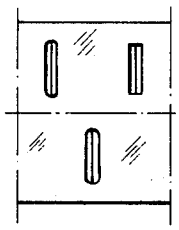
Figure 19B:
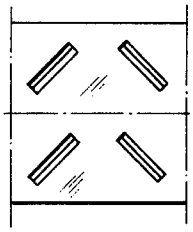
Figure 19C:
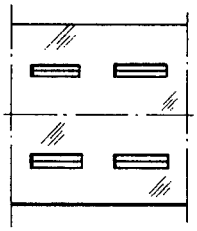
Figure 19D:
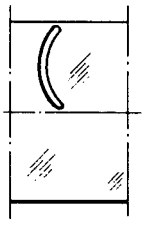
Figure 19E:
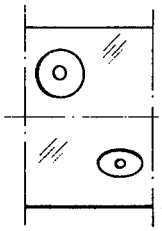
Figure 19F:
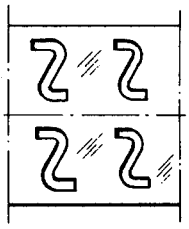
Figure 19G:
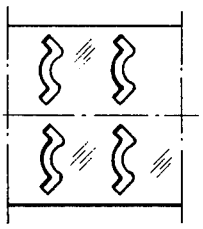
Figure 21A:
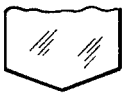
Figure 21B:
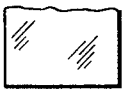
Figure 21C:
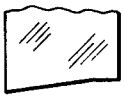
Figure 21D:
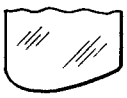
Figure 21E:
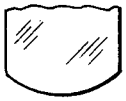
Figure 20:
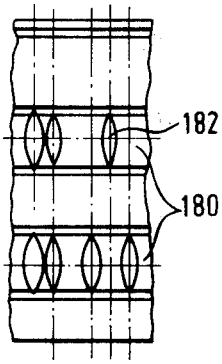
Figure 22:
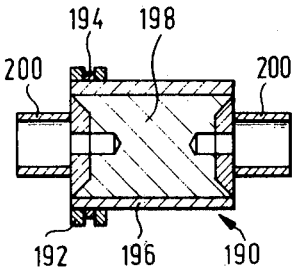
Figure 23:
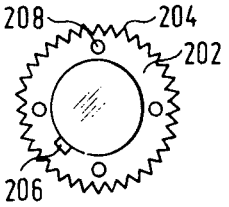
Figure 24:
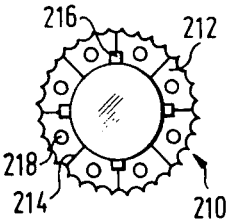
Figure 25:
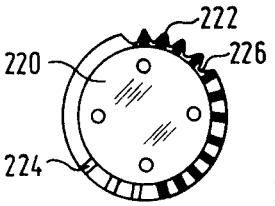
Figure 26:
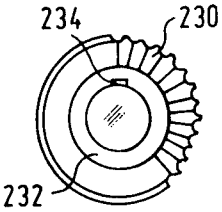
Figure 28A:
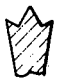
Figure 28B:
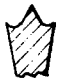
Figure 28C:
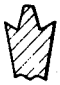
Figure 28D:
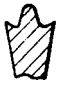
Figure 28E:
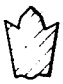
Figure 28F:
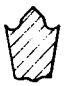
Figure 28G:
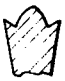
Figure 28H:
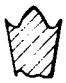
Figure 28I:
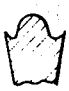
Figure 28J:
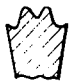
Figure 28K:
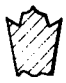
Figure 28L:
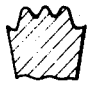
Figure 28M:
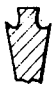
Figure 28N:
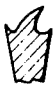
Figure 28O:
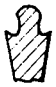
Figure 27:
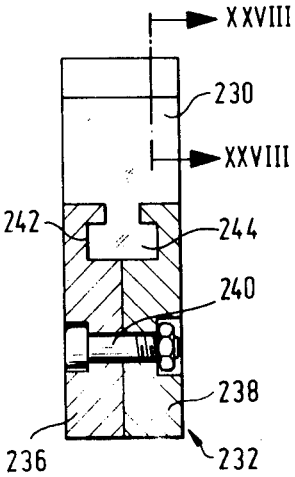
Figure 29:
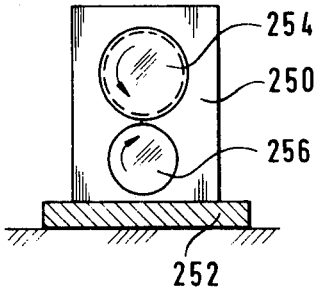
Figure 30:
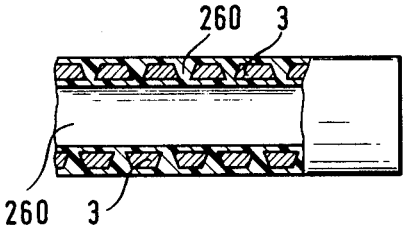
Figure 31:
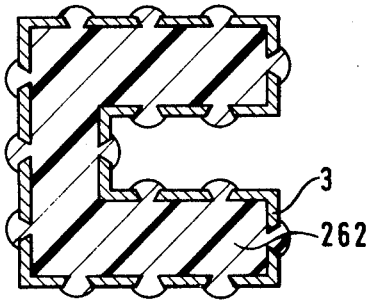

The invention will be described further, by way of example, with reference to the accompanying drawings, in which:

FIG. 1 is a diagrammatic side elevational view of a sheet steel rolling apparatus in accordance with the invention, FIGS. 2*a* and 2*b* are diagrammatic cross sectional views of part of another sheet steel rolling apparatus according to the invention, showing only the two roller pairs on separate roller stands, FIGS. 3*a* and 3*b* are side elevational views of the roller pairs shown in FIGS. 2*a* and 2*b*, respectively, FIGS. 4*a* and 4*b* are top plan views of the sheet material, FIG. 4*a* showing the notching result obtained by the roller pair according to FIG. 2*a*, and FIG. 4*b* showing the reduced thickness and stretching result obtained by the roller pair shown in FIG. 2*b*, FIGS. 5*a* and 5*b* are diagrammatic cross sectional views of two roller pairs, the roller pair according to FIG. 5*a* effecting the notching and the one according to FIG. 5*b* serving for thickness reduction and stretching, FIG. 5*c* is a diagrammatic top plan view of the sheet material during passage through the two roller pairs shown in FIGS. 5*a* and 5*b*, FIGS. 6*a* to 6*d* are sectional views of the sheet material shown in FIG. 5*c*, as seen along lines A to D of FIG. 5*c*, FIGS. 7*a* to 7*c* are sectional views of the sheet material, FIG. 7*a* showing the starting material, FIG. 7*b* showing the sheet material after a first transit and FIG. 7*c* after another pass, FIG. 8 is an enlarged top plan view of the perforated sheet material shown in FIG. 4*b*, FIG. 9 is a sectional view of the sheet material, taken along line IX — IX in FIG. 8, FIG. 10 is a diagrammatic view of two notching rollers forming notches at both sides of the sheet material, FIG. 11 is a top plan view of a sheet material section with openings resulting from the notches formed in accordance with FIG. 10, FIG. 12 is a sectional view of the sheet material section, taken along line XII — XII in FIG. 11, FIG. 13 is a diagrammatic view of two notching rollers, similar to those of FIG. 10, with the rows of teeth off-set relative to each other on the two rollers, FIG. 14 is a sectional view of a sheet material section with openings resulting from the notches formed in accordance with FIG. 13, FIG. 15 is a diagrammatic view of a heating device for fusion deforming of the edges of the openings, FIG. 16 is a top plan view of a section of sheet material with openings having their edges deformed by fusion, FIG. 17 is a diagrammatic cross sectional veiw of different embodiments of webs remaining between the openings, FIG. 18 is a sectional view of sheet material subjected to profiling during or after the formation of the openings, FIGS. 19*a* to 19*g* are diagrammatic illustrations of different shapes of notches, FIG. 20 is a top plan view of a sheet material section showing different numbers of openings in different rows, FIGS. 21*a* to 21*e* are side plan views of notching teeth, specifically of the course of the cutting edge of the teeth, FIG. 22 is a longitudinal sectional view of a roller having two roller rings and a spacer ring, FIG. 23 is a cross sectional view of a roller ring with notching teeth, FIG. 24 is a cross sectional view of a roller ring with notching teeth, showing the ring sub-divided into sections, FIG. 25 is a cross sectional view of a roller ring with cast-in notching teeth, FIG. 26 is a cross sectional view of a roller ring with notching teeth fixed to the roller ring periphery, FIG. 27 is another sectional view of the roller ring according to FIG. 26, showing a notching tooth from the side, FIGS. 28*a* to 28*o* are diagrammatic illustrations of different forms of notching teeth, specifically of those portions which will contact the sheet material, FIG. 29 is a diagrammatic cross sectional view of a roller stand with two rollers, of which the top roller is a combination notching and profiling roller, FIG. 30 is a sectional elevation of a pipe section made from perforated sheet material in accordance with the invention and coated with plastics, FIG. 31 is a sectional elevation of a semi-finished product made from perforated sheet material in accordance with the invention adapted to be processed to form window frames.

The invention will be described below with refence to the manufacture of perforated sheet steel bands which are a cheap mass-produced article. However, it is to be understood that the invention is suitable also for use with other metallic materials and some thermoplastics.

FIG. 1 diagrammatically shows a rolling apparatus suitable for production of the openings in the band. The band 1 is wound on a reel 4 which is supported in per se known manner on a bracket 5. The band is passed from reel 4 through a band guide means 6, a tension regulating means 8 toward the nip between a notching roller 10 and a counter-roller 12, around the counter-roller 12 to a second nip between the counter-roller 12 and a profile roller 14, another band guide means 16 toward a second reel 18 on which the band 3 which is now perforated is wound up. Reel 18 is likewise supported on a bracket 20 in per se known manner. The band guide means 6, 16, the tension regulating means 8, and rollers 10, 12, 14 are arranged in per se known manner on a roller stand 22 which need not be described in detail. By a socket 24 roller stand 22 rests on the floor 26. Such a roller stand comprising three rollers is known per se, with the exception of the design of rollers 10 and 14 which is characteristic of the invention. In such roller stands comprising three rollers the nips are adjustable and at least one of the rollers is driven. For the sake of simplicity the means for adjusting the roller nips and for driving the apparatus are not shown because they are likewise known per se. With the apparatus according to the invention driving of the rollers themselves may be dispensed with if the band transport is taken over by the reel on which the perforated band is wound up. Presumably, driving of the rollers themselves may be dispensed with because the rollers 10 and 14 are taken along, if external band transport is provided, because of their specific function in the apparatus according to the invention, namely to produce notches and reduce the thickness and stretch partial areas of the band, respectively.

As will be described in more detail below, it may be desirable to subject the perforated band several times to the thickness reducing and stretching processing step. For this purpose, the rolling apparatus according to FIG. 1 may be of the reversing kind, a band drive means being provided at both reels 4 and 18. During the repeated processing by profile roller 14 and counter-roller 12 the notching roller 10 is taken out of operation.

FIGS. 2*a* and 2*b* show another embodiment of the rolling apparatus according to the invention. This embodiment comprises two roller stands 30 and 32. Roller stand 30 which rests on a socket 34 comprises a notching roller 36 and a smooth counter-roller 38. Roller stand 32 comprises profile roller 40 and counter-roller 42.

The notching roller 36 has a roller body 44 in which a coupling element 46 for coupling the drive means of this roller is diagrammatically shown. The roller body 44 carries roller rings 48 with notching teeth 50. FIG. 3*a*, showing a lateral view of rollers 36 and 38, indicates how roller 36 is composed of roller rings 48 with notching teeth 50 and spacer rings 52.

Also roller 40 may be composed of roller rings. FIG. 3*b* is a lateral view of rollers 40 and 42. Roller 40 is alternatingly composed of profile roller rings 60 and spacer rings 62. The diameter of spacer rings 62 is smaller than the diameter of profile rings 60 by at least twice the amount of the thickness reduction.

Band 1 moves from the left, as seen in FIG. 2*a*, into the nip between rollers 36 and 38 where it is provided with notches by the teeth 50 on roller 36. Then the notched band 2 continues to move through the nip between rollers 40 and 42 where the notches are enlarged by the thickness reduction and stretching in the areas of profile rings 60. The kind of notching and the widening of the notches to form openings or wholes are shown in detail in FIGS. 4*a* and 4*b*. In correspondence with the arrangement of the roller rings 38 having the notching teeth 50 on roller 36 notches 70 are formed in band 2 (FIG. 4*a*), these notches are disposed in two paths or rows beside each other. The perforated band 3 shown in FIG. 4*b* is the product upon processing by roller 40. As may be taken from FIG. 4*b* those areas 72 in which the thickness is reduced and which are stretched are so selected that the ends of the notches and thus the lateral ends of openings 74 are covered by the thickness reducing processing step. The width of areas 72 corresponds to the width of profile roller rings 60 (FIG. 3*b*). The openings in the sheet material may be obtained, in accordance with the invention, by hot rolling (temperature of the band during rolling approximately 400°-500° C) or by cold rolling (temperature of the band up to approximately 80° C). If the areas 72 are selected as described so as to overlap the ends of notches 70 or openings 74, a soldering effect of the notch ends and a flow of material are caused during the hot rolling so that a compensation of tensions is obtained in the marginal zones between the thinner rolled areas 72 and those areas which have passed through the nip between rollers 40 and 42 without any reduction in thickness and in which the main portion of the openings 74 lies. Also during cold rolling the tensions are reliefed if there is an overlapping of the areas 72 and the ends of the notches or openings 74 because the ends of the notches are pressed together by the deforming operation.

FIGS. 5*a*, *b*, and *c* essentially correspond to FIGS. 2*a*, *b* and 4*a*, *b* described above in that FIGS. 5*a*, *b* and *c* show two roller pairs for making the openings in the sheet material and the kind of changes in the sheet material respectively. FIG. 5*a* discloses a notching roller 80 composed of notching roller rings 82, a roller body 84, and a roller shaft 86. The notching roller rings 82 are provided with notching teeth 88. Also the counter-roller 90 is composed of rings 92, a roller body 94, and a roller shaft 96. The band 1 moves from the left, as seen in FIG. 5*a*, into the roller nip between rollers 80 and 90 where it is provided with notches 98. This procedure is shown in a top plan view in the upper part of FIG. 5*c*. As it is introduced band 1 has the cross section shown in FIG. 6*a* along the line indicated A in FIG. 5*c*. Then the band moves under roller 80, shown from the top in FIG. 5*c*. This top plan view of roller 80 further shows that the roller is completely composed of notching roller rings, the notching teeth 88 of adjacent rings 82 being offset by half the spacing between the notching teeth on one ring. The resulting arrangement of the notches 98 on band 2 is shown in FIG. 5*c* below roller 80. The ends of notches 98 essentially lie on lines which extend in parallel with the edges of the band. The cross sectional configuration of band 2 at line B in FIG. 5*c* may be taken from FIG. 6*b*.

FIG. 5*b* shows the roller pair composed of profile roller 100 and the associated counter-roller 102. Roller 100 comprises profile roller rings 104, spacer rings 106, a roller body 108, and a roller shaft 110. The roller 102 is likewise composed of roller rings 112, a roller body 114, and a roller shaft 116, although this roller may also be a plain one. Roller 100 is again shown in top plan view in FIG. 5*c* which particularly illustrates the arrangement of the profile roller rings 104 and the spacer rings 106. As will be seen, profile roller rings 104 are half as wide as the notching roller rings 82 of roller 80. Moreover, the center line of the profile roller rings 104 in each case is essentially disposed above a line on which the ends of notches 98 lie. This dimensioning of the width of the profile roller rings 104 and the position of the profile roller rings across the width of roller 100 provides the overlapping of areas 118 which are rolled to lesser thickness by roller 100 and of the ends of the notches or openings 120. However, it is to be noted that half of the length of notches 98 or openings 120 is not covered by the areas 118 so that the desired enlarging of the notches to form openings 120 may take place, as shown in the lower part of FIG. 5*c*. FIG. 6*c* is a section through the perforated band 3 of FIG. 5*c* along line C, while FIG. 6*d* is a section through the perforated band 3 along line D in FIG. 5*c*. FIG. 6*c* shows above all the course of the side surfaces 122 of openings 120. FIGS. 6*c* and 6*d* both show the reduction in thickness of band 3 in areas 118.

So far it was assumed that the band 1 introduced had a uniform even cross section. If such a band is processed to a perforated band 3, the surface profile obtained is as shown in FIG. 6*d*. However, a perforated band 3 may also be made from a starting material which has a profiled cross section as shown in FIG. 7. The band 1 introduced in accordance with FIG. 7*a* has a two-sided profile of a kind in which thick sections 130 alternate with thinner sections 132. The notches are made in the thinner sections 132, and then the material is rolled to the same thickness throughout, the thicker sections 130 being reduced to the thickness of the thinner sections 132. The results, a perforated band 3, has the uniform cross section shown in FIG. 7*b*. This band 3, however, may be processed once more by the profile roller so that sections 132' which correspond to sections 132 now have a greater thickness than the individual sections 130' which originally were thicker than sections 132. Of course, this repeated processing by the profile roller enlarges the openings still further so that the area relationship between the are a of the openings and the area of band 3 can be varied by corresponding selection of the cross sectional profile in the starting material and the number of passes through the roller nips. In this manner a surface ratio of 50% may be obtained, in other words, 50% of the area of band 3 consists of openings. Such a surface ratio approximately meets the requirements of construction steel mats.

With reference to FIG. 8–14 it will now be explained how the configuration of the edges of the openings can be influenced by the shape and location of the notches in the sheet material. If the notches in band 1 are designed as described in connection with FIGS. 2*a* and 4*a*, the openings 74 have a shape which is shown on an enlarged scale in FIG. 8 and in sectional elevation in FIG. 9. The material of the band will tear up in the vicinity of the underside of the band while the partial areas of the band are rolled to a diminished thickness. The resulting edges 74' are more of less fuzzy (FIGS. 8 and 9), and the sides of the opening have a conical shape. FIG. 10 is a diagrammatic presentation of two notching rollers 140 providing notches at both sides of a band 1 so that the tips of the notches are opposed to one another. During the subsequent thickness reducing processing step this arrangement of the notches provides openings 142 as shown in the section of perforated sheet material according to FIG. 11, which is a top plan view, and according to FIG. 12, which shows the band 3 in section. The openings 142 have a double conical side surface and a smooth edge 144. If the two notching rollers 140 are directed in such manner with respect to each other as shown in FIG. 13, that the notches produced by the notching teeth in band 1 are offset with respect to one another in longitudinal direction of the band, the cross sectional configuration of band 3 is as shown in FIG. 14, having openings 146 which are broadened alternatingly toward the two sides of the band. These are some examples of different designs of the edges of the openings selected in accordance with the respective requirements. The conical shape of the sides of the openings is advantageous in connection with coating the perforated band with plastics, because thereby a better composite action between the perforated band and the plastics is obtained as compared to the composite action obtainable between a punched sheet having holes with perpenticular sides and plastics.

As already mentioned, it is possible that the openings tear out at the ends if the perforated band 3 is subjected to heavy oscillation stress. To improve the oscillation loading capacity of the perforated sheet material, it is heated briefly in accordance with the invention so that the edges of the openings suffer fusion deformation. For this purpose a heating means 150, shown as a box in FIG. 1 and shown diagrammatically in FIG. 15, is provided along the path of the perforated band 3 FIG. 1 shows in addition how the sheet material is guided not only through guide means 16 but also through guide rollers 152 so that it passes through the heating means 150 in a straight path. According to FIG. 15 the heating means 150 consists of an arrangement of gas burners 154 oriented in the direction of movement of the band as well as transversely thereof in a field. The burners 154 are mounted on a housing 156 which contains the gas feed pipes. A protective casing 158 surrounds the burners up to a position in the vicinity of the plate at which the perforated band 3 moves through the heating means. At the opposite side of band 3 a hood 160 is provided to which inert gas is supplied. Such inert gases are known from the arc welding technique. The inert gases prevent admission of oxygen so that the surface of the perforated sheet material does not become covered with an oxide layer by treatment with the gas flames.

If a perforated band as shown in top plan view in FIG. 8 is passed through heating means 150, a perforated band 3 is obtained a section of which is shown in FIG. 16 in top plan view. The edges 170 of the openings 172 were deformed under fusion. Near the ends of the openings there are beads 174 which prevent the openings from tearing further at the ends 176 of the original notches. The perforated band 3 shown in FIG. 16 consequently is much more stable against oscillation loading than the previously shown embodiments.

FIGS. 17 and 18 show a possible further processing step of the perforated sheet material. FIG. 17 shows how the webs which remain between the openings can be deformed out of the plane of the sheet material by a subsequent processing step. This subsequent processing may be carried out with the aid of appropriately profiled rollers, by rams or similar means. It is also possible to impart to the perforated sheet material a profile such as shown in FIG. 18, either during the pass through the profile rollers or in a subsequent operating step. FIGS. 17 and 18 show that the pass through the roller nip for producing the openings in accordance with the invention may also include additional processing steps to be performed on the final product. The further embodiments shown in FIGS. 17 and 18 of the perforated sheet material in accordance with the invention present additional advantages, especially in the coating of the perforated band with plastics or in certain cases of application of the perforated band, such as forms or construction material.

FIGS. 19*a-g* are diagrammatic top plans views of some different embodiments and arrangemants of the notches in the sheet material. The openings which result from such notches have edges substantially similar to the original notches, changes in the course of the edges resulting only from stretching, for instance, as shown in FIG. 5*c* for an arrangement of notches of similar design as that shown in FIG. 19*a*. However, it should be noted that the area of the openings can be influenced by the angle included between the notches and the direction of movement of the band. For example, the area of the openings at equal stretching is larger if the notches are arranged perpenticularly to the direction of movement or longitudinal direction of the sheet material as shown in FIG. 19*a* than in the case in which the notches are at an angle with respect to the direction of movement, such as shown in FIG. 19*b*. The arrangement of notches according to FIG. 19*c* produces openings of minimum size which, however, are desirable for certain purposes such as fine screens. The openings of minimum size are produced be frictionally rolling the material, whereby the rollers are disposed at an angle to the longitudinal direction of the sheet material and a variing thickness reduction takes place over the bredth of the sheet material. The further notch shapes shown in FIGS. 19*d*-19*f* illustrate the great variety of the geometric design of the notches by which the most varied mechanical and esthetic effects can be obtained.

It may be gathered from FIG. 20 which shows a section of the perforated band 3 that the arrangement of the openings in the area is likewise widely variable. The area of the individual openings 182 in transverse direction of the band can be varied by applying a different number of openings per unit length in the individual rows 180 of notches or openings. The smaller the number of openings per unit length in a row, the greater is the area obtained of each individual opening.

While FIG. 19 essentially shows the course of the cutting edge of the notching teeth in a plane parallel to the plane of the sheet material, FIG. 21 shows the course of the cutting edge of different notching teeth in a plane vertical to the plane of the sheet material. The different forms of cutting edges shown in FIG. 21, for instance, make it possible to vary the thrust point of the openings. An opening which was prepared with a notching tooth as shown in FIG. 21*a* will split open first in the center of the notches and then progress toward the sides. If a notching tooth according to FIG. 21*b* is used, the opening will presumably brake open more or less evenly over the entire length. With a notching tooth according to FIG. 21*c*, on the other hand, the notch will begin to split open with a jerk at the left end, while a less jerky splitting open is to be expected when a notching tooth according to FIG. 21*d* is used. With an embodiment according to FIG. 21*e* the notch will probably split open from the center toward the sides in very little jerky manner.

It was already stated above that the notching rollers and the profile rollers preferably are composed of roller rings. Some embodiments of roller rings in connection with notching rollers will now be described with reference to FIGS. 22–26, the embodiments of FIGS. 22–24 also being applicable to the profile roller rings and spacer rings. FIG. 22 shows a roller 190 in section with the arrangement of roller rings 192 which may be notching roller rings or profile rings. A spacer ring 194 is shown between the roller rings 192. The rings are mounted on a roller jacket 196 which in turn is mounted on a roller core or roller body 198. Axle journals 200 are connected to the roller body 198. FIG. 23 shows a notching roller ring 202 integrally formed with notching teeth 204. The roller ring 202 has a groove 206. The roller ring 202 is fixed on roller 190 by driving a wedge into groove 206 and a corresponding groove provided on roller 190. The roller ring 202 further includes bores 208 for insertion of bolts or screws upon assembly of the rollers to connect the roller rings to one another. FIG. 24 shows another embodiment of a roller ring 210 illustrated as notching roller ring. In contrast to notching roller ring 202 this ring 210 consists of individual ring sections 212 which are form-locked to each other at the boundary faces 214 at which the ring sections abut against each other. The roller ring 210 obtained in this manner is fixed by a wedge joint on the roller in a manner similar to roller ring 202, utilizing the grooves 216. Again bores 218 serve for connection of the individual roller rings by bolts.

FIG. 25 shows an embodiment of notching rollers or notching roller rings 220 which are largely made of cheap mass produced steel instead of tempered refined steel. The rings are provided with notching teeth 222 of high quality steel. The notching roller ring shown is produced by first making bores 224 into which subsequently refined steel is cast. Thereupon correspondingly shaped grooves 226 are milled out of the material so that the notching teeth 222 made from refined steel remain.

In the case of the notching roller ring shown in FIG. 26 the notching teeth 230 are individually fixed to a ring 232. Again ring 232 has a groove 234 for fixing on the roller body, as described above. FIG. 27 is a radial sectional view of ring 232 and a side elevational view of a notching tooth 230. The ring 232 is made up of two partial rings 236, 238 which are screwed together by bolts 240. The partial rings 236, 238 are given such shape at the sides facing each other in the vicinity of their outer circumference that a cut-out recess 242 is formed. This recess 242 serves for anchoring of the notching tooth 230 by a correspondingly shaped foot 244. FIGS. 28*a* - 28*o* show different tooth shapes in the outer area of the teeth 230, substantially long line XXVIII-XXVIII of FIG. 27. As stated before, the shape of the edges of the openings may also be influenced by the shape of the teeth. The configuration of the notches formed by the teeth shown in FIG. 28 results from the cross sectional shape of the teeth according to FIG. 28 in consideration of their rolling-off during the notching process.

As explained before, different roller means are suitable to carry out the transits required to realize the method according to the invention. An advantageous arrangement was already described in connection with FIG. 1. Another advantageous roller arrangement is shown diagrammatically in FIG. 29. A roller pair is arranged in a roller stand 250 resting on a socket 252. The upper roller is a combination roller 254 provided with notching roller rings as well as profile roller rings, while the lower roller is a plain counter-roller 256. The notching roller rings may have a design in accordance with FIGS. 23–26, whereas the profile roller rings disposed between them may be of the kind shown in FIG. 3*b*. When a band 1 is transported through the nip between rollers 254 and 256, the notches are made by the notching roller rings of roller 254 and, at the same time, the band is reduced in thickness and stretched at the respective partial areas by the profile roller rings. As with the other embodiments of the apparatus according to the invention, the depth of the notches and the degree of thickness reduction during a pass are not of critical importance. The notches could extend completely through the sheet material. This, however, will lead to increased wear of the counter-roller. As it is not required for proper realization of the method according to the invention that the notches be made all the way through the sheet material, the counter-roller may be protected by applying the notches in such manner that the cross section of the sheet material is only sufficiently weakened. The degree of thickness reduction during the stretching of the sheet material depends on the general values obtaintable during cold rolling or hot rolling of sheet material and is known to those skilled in the art.

The roller means described above permit a production speed of approximately 400 meters per minute of perforated sheet material. This must be considered a good result. Extensive tests for producing perforated sheet material furthermore showed that it is sufficient to drive only one roller and that, in some cases, it is even possible to pull along all the rollers, in other words to transport the band exclusively by means of the take-up reel. In practice this is of great advantage in that old rollers which otherwise have become useless and are of different diameter can still be used as plain counter-rollers or as roller bodies carrying the roller rings. This provides considerable savings in machine expenditure. Another advantage with apparatus according to the invention resides in the fact that the specific problem of tensions otherwise created during rolling processes does not occur when carrying out the method of the invention or operating the apparatus according to the invention. It is known that undesired tensions occur when processing a starting material on metal basis, such as copper, steel or aluminum. For this reason it has always been necessary to anneal the material between the individual transits in order to make it elastic and capable of being processed again. True, also with the method according to the invention tensions are created in the sheet material. However, it was discovered that additional annealing before or after applying the method according to the invention is not necessary because the inherent tensions in the metal band can escape into the resulting openings during the thickness reducing and stretching processing step.

Finally, another advantage of the perforated sheet material produced in accordance with the invention resides in its excellent suitability for being coated with and/or surrounded by plastics. This will be explained with reference to the following example of application. FIG. 30 is a section through a metal pipe produced by use of a perforated band 3 according to the invention. The band 3 is bent into tubular shape and welded and then coated with plastics 260 which also fills the openings in band 3. By virtue of the conical shape of the sides of the openings in band 3 the pipe can be coated with plastics at the inside and outside in a single process, and a composite article out of the perforated sheet material, being the metal inlay, and the plastics 260 is obtained. This pipe essentially has the mechanical strength of the metal tube formed of perforated sheet material and the corrosion resistance of the plastics surrounding the metal inlay.

Another example of application of perforated sheet material in accordance with the invention is shown in FIG. 31 which illustrates a sectional article, such as used for producing window frames. The inside of the sectional article is filled with foam 262 to provide good thermal insulation. The perforated sheet material practically is the mold for the foam. A sectional article prepared in this manner may then be coated in per se known manner with plastics on the outside as well to provide an article which is completely resistant to corrosion.

The perforated sheet material in accordance with the invention has many other fields of application, for example in construction where it can be used in the form of steel mats or supporting elements. In these cases the perforated sheet material remains uncoated. The perforated sheet material provided with a corrosion-resistant coating, for example of plastics, enamel, paint or the like and with open apertures is suitable for noise attenuation. Further fields of application result if flat material is required to have a high mechanical load-taking capacity and corrosion resistance.

What is claimed is:

1. A process for producing openings in sheet material, said openings being aligned in a longitudinal direction of said material, comprising the steps of:

deforming the sheet material to provide notches therein arranged in rows extending in said longitudinal direction; and reducing the thickness of partial areas of the notched sheet material between said rows, said partial areas including the ends of the notches, thus enlarging the notches which lie between the reduced thickness partial areas of the notched sheet material to form openings extending between the major surfaces of said sheet material.

2. The process according to claim 1 wherein said deforming step provides notches which extend through less than the entire thickness of said sheet material.

3. The process according to claim 1, wherein said deforming step includes passing said sheet material between said toothed roller and another toothed roller to form notches on both major surfaces thereof.

4. The process according to claim 1, comprising the additional step of heating said sheet material after said thickness reducing step to deform the edges of said openings.

5. The process according to claim 1, wherein a toothed roller is utilized to perform said deforming step, and the teeth of said toothed roller are longer at a point between the edges thereof than of said edges, so that said teeth first deform said sheet material at points intermediate the edges of the corresponding notches.

6. The process according to claim 1, comprising the additional step of forming said sheet material so that said notches lie in a different plane than other parts of the sheet material.

7. The process according to claim 1, wherein said notches are elongated in a direction angularly displaced from said longitudinal direction.

8. The process according to claim 1, comprising the additional step of coating said sheet material with a plastic substance, after said thickness reducing step.

9. The process according to claim 1, wherein said material is steel.

10. The process according to claim 2, wherein said steps are carried out while maintaining said web at a temperature in the range of 400° to 500° C.

11. A perforated sheet product made by the process of claim 11.

12. A perforated sheet product made by the process of claim 2.

13. The process according to claim 1, where the notches in a given row of said sheet material are staggered with respect to notches in adjacent rows thereof.

14. Apparatus for producing openings in sheet material, said openings being aligned in a longitudinal direction of said material, comprising:

a roller and a cooperating counter-roller for deforming sheet material to produce rows of notches therein, said rows extending in said longitudinal direction, at least one of said rollers having notching teeth distributed over the circumferential surface thereof, said teeth being arranged in rows oriented in said longitudinal direction, at least one of said rollers having raised profile faces for reducing the thickness of said sheet material in strips extending in said longitudinal direction and disposed between said rows of notches, the width of said profile faces being such that said reduced thickness strips include the ends of said notches, said rollers being spaced apart by a distance less than the initial thickness of said sheet material; and means for producing relative rolling motion between said rollers and said sheet material.

15. The apparatus as claimed in claim 14, in which the roller having notching teeth comprises a roller body and roller rings mounted on the roller body, at least some of the roller rings having notching teeth, said rings being spaced apart from each other on said roller body, said notching teeth comprising material cast into the corresponding roller rings.

16. The apparatus as claimed in claim 14, in which the roller having notching teeth comprises a roller body and roller rings mounted on the roller body, at least some of the roller rings having notching teeth, said rings being spaced apart from each other on said roller body, said notching teeth being individually affixed to the circumferential surfaces of the corresponding roller rings.

17. An apparatus as claimed in claim 16, in which the roller rings each comprise at least two partial rings connected to each other to fasten the notching teeth, forming a cut-out recess in the vicinity of the outer circumference in which the notching teeth are anchored by complementary feet.

18. An apparatus as claimed in claim 14, further comprising heating means for fusing the edges of the openings of the sheet material.

19. Apparatus for producing openings in sheet material, said openings being aligned in a longitudinal direction of said sheet material, comprising:

a notching roller having notching teeth, a profile roller, and a common counter-roller adjacent said notching and profile rollers, said notching roller cooperating with said counter-roller for deforming sheet material to produce rows of notches therein extending in said longitudinal direction, said profile roller cooperating with said counter-roller to reduce the thickness of said sheet material in strips extending in said longitudinal direction and disposed between said rows of notches, the width of said profile roller being such that said reduced thickness strips include the ends of said notches, said counter-roller being spaced apart from said other rollers by distances less than the initial thickness of said sheet material; and means for feeding said sheet material between said counter-roller and each of said other rollers.

20. Perforated sheet material having openings produced by providing notches therein and stretching partial areas, including the edges of said notches to reduce the thickness thereof, the edges of said notches therefore being less thick than the remaining portions of the notches, said notches being enlarged by said stretching to form openings in said sheet material, the edges of said openings, corresponding to the edges of said notches, being deformed by heat-induced fusion thereof.

* * * * *

UNITED STATES PATENT OFFICE

CERTIFICATE OF CORRECTION

Patent No. 4,068,366 Dated January 17, 1978

Inventor(s) Hans Hillesheim

It is certified that error appears in the above-identified patent and that said Letters Patent are hereby corrected as shown below:

Column 15, line 8: "of" should be --at--.

line 28: "claim 11" should be --claim 1--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*